United States Patent [19]

Vance

[11] Patent Number: 4,686,926

[45] Date of Patent: Aug. 18, 1987

[54] BOAT MOORING DEVICE

[76] Inventor: Duane R. Vance, 1247 Deerfield Dr., St. Paul, Minn. 55119

[21] Appl. No.: 844,516

[22] Filed: Mar. 27, 1986

[51] Int. Cl.[4] ..... B63B 21/00

[52] U.S. Cl. ..... 114/230; 114/219; 114/250; 267/170; 267/179; 403/117; 16/371

[58] Field of Search ..... 114/230, 250, 219; 267/170, 179, 74, 139; 16/371, 374; 403/117, 113, 157; 384/220, 222, 273

[56] References Cited

U.S. PATENT DOCUMENTS

| | | | |
|---|---|---|---|
| Re. 25,372 | 4/1963 | Dick . | |
| 1,772,560 | 8/1930 | Soss | 16/374 |
| 2,514,394 | 7/1950 | Irving | 267/170 |
| 2,653,838 | 9/1953 | Danly et al. | 403/157 |
| 2,715,314 | 8/1955 | Smith | 114/230 |
| 3,064,615 | 11/1962 | Waltman | 114/230 |
| 3,110,464 | 11/1963 | Baratoff et al. | 267/170 |
| 3,117,838 | 4/1965 | Grimes | 114/230 |
| 3,139,852 | 7/1964 | Morris | 114/230 |
| 3,157,150 | 11/1964 | Faber, Jr. . | |
| 3,196,824 | 7/1965 | Howard | 114/230 |
| 3,793,685 | 2/1974 | Knecht . | |
| 4,144,831 | 3/1979 | Heydolph . | |
| 4,148,107 | 4/1979 | Karl et al. . | |
| 4,250,827 | 2/1981 | Booker et al. . | |
| 4,493,282 | 1/1985 | Ortloff . | |

*Primary Examiner*—Jeffrey V. Nase
*Assistant Examiner*—Thomas J. Brahan
*Attorney, Agent, or Firm*—Jacobson and Johnson

[57] ABSTRACT

A pair of identical rigid arms are each pivotably attached at one end to a pair of identical brackets, one bracket attached to a boat and the other bracket attached to a dock, and an elongated helically wound spring is threaded on to each end of the arms to connect them together. The arms are held in place at the bracket by pins or rods which, particularly at the boat bracket, can be quickly and easily removed to free the boat.

3 Claims, 4 Drawing Figures

BOAT MOORING DEVICE

FIELD OF THE INVENTION

This invention is for the purpose of attaching a boat alongside or to the end of a dock while permitting the boat to rock and roll with the motion of the water without breaking loose or bumping the dock.

DESCRIPTION OF THE PRIOR ART

There are a number of devices which have been used for the same purpose as the instant invention but they have some drawbacks. In some cases the prior art devices are constructed so that certain types of motion of a boat sitting in the water places undue strain on the mooring device causing it to rupture or collapse or break loose. Another drawback is that to overcome the aforementioned difficulty, some of the prior art devices are made somewhat complex with a number of different parts which makes the device quite expensive to manufacture therefore resulting in a relatively high selling price. In addition, some of the prior art devices are somewhat cumbersome or awkward to use and have to be detached and removed from the dock to be stored away when not in use.

SUMMARY OF THE INVENTION

In the preferred form of this invention, a pair of rigid identical arms each are pivotably attached at one end to one of a pair of identical brackets, one bracket on the dock and the other bracket on the boat. The other ends of the rigid arms are connected together by a helically wound spring which is threaded onto the ends of the arms. The combination of the pivotal attachment to the brackets, the spring connection between the two arms and the threaded engagement of the spring to the arms accommodates all of the various motions that a boat may have while resting in the water alongside the dock without placing any undue strain on the mooring fixture.

As a further feature, the arms are attached to their respective brackets by pins or rods passing through the sides of the bracket and through a trunnion at the end of the arms. To release the fixture from the boat bracket the pin is merely slipped out of the bracket opening so the arm can be removed from the bracket to set the boat free.

As still a further feature, in the preferred embodiment, the dock bracket is attached near the edge of the dock so when the arm is released from the boat bracket the arms with the interconnecting spring will swing downward about the pivotable attachment to the dock bracket to rest along the side of the dock so that the device is out of the way and not jutting out from the dock. In an alternate embodiment, the dock bracket may be rotatably mounted on a plate which is attached to the dock so when the device is disconnected from the boat bracket, the arms and interconnecting spring can then be swung around to rest on top of the dock and not jut out from the dock. The brackets, the means for attaching the arms to the brackets and the arms are identical to one another so only a few component parts are necessary thereby making the device less costly to manufacture and easy to put together and use.

DESCRIPTION OF THE PREFERRED EMBODIMENTS

Figure 1:
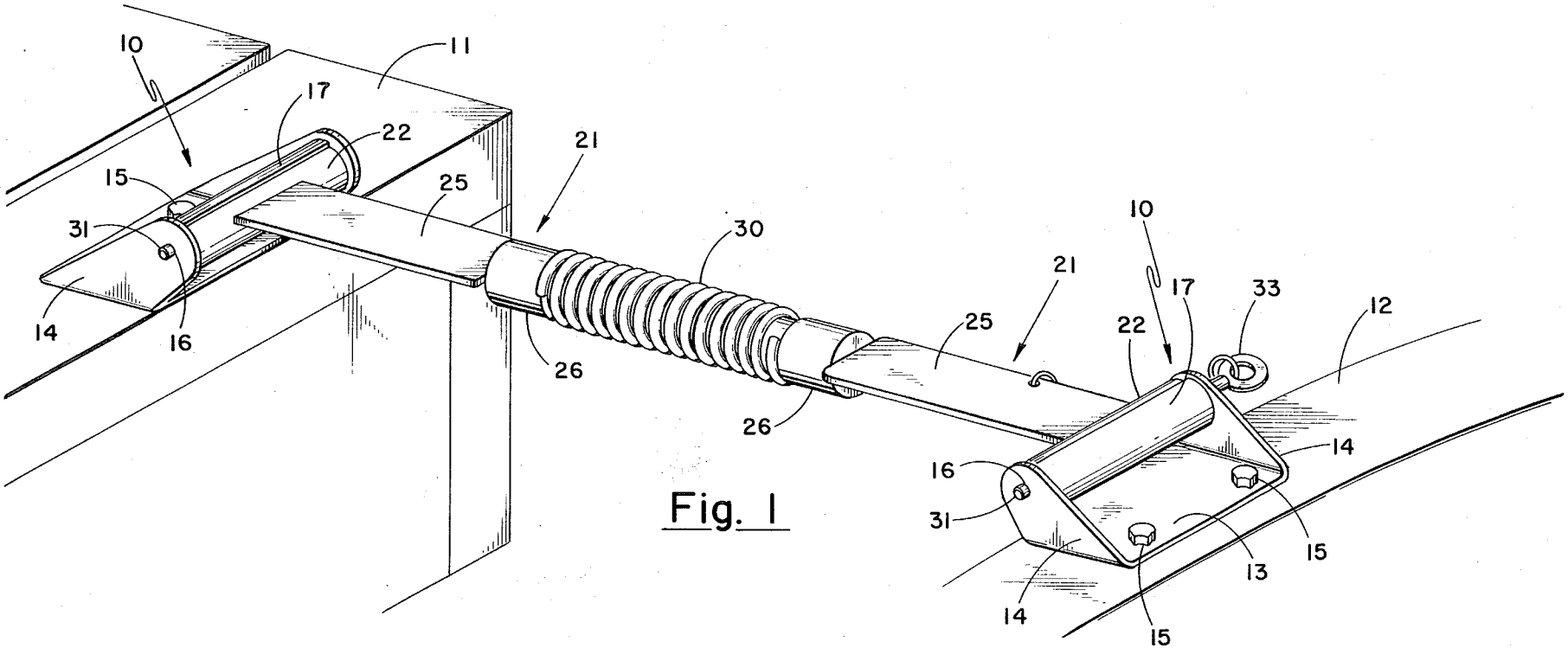
FIG. 1 is a perspective view of an embodiment of the invention as it would appear in normal use.
Figure 2:
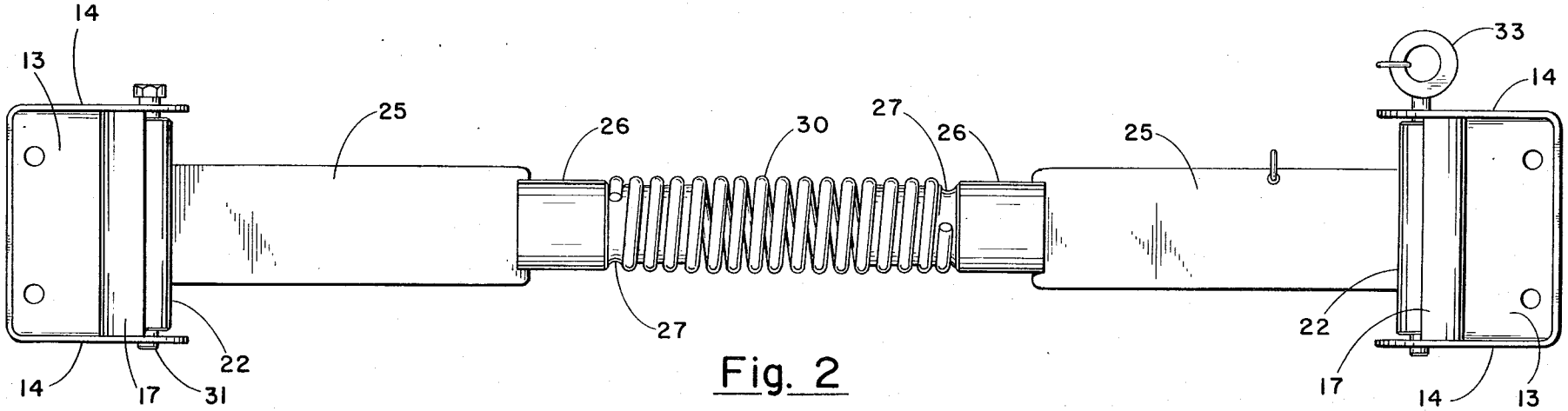
FIG. 2 is a top plan view of an embodiment of the invention.
Figure 3:
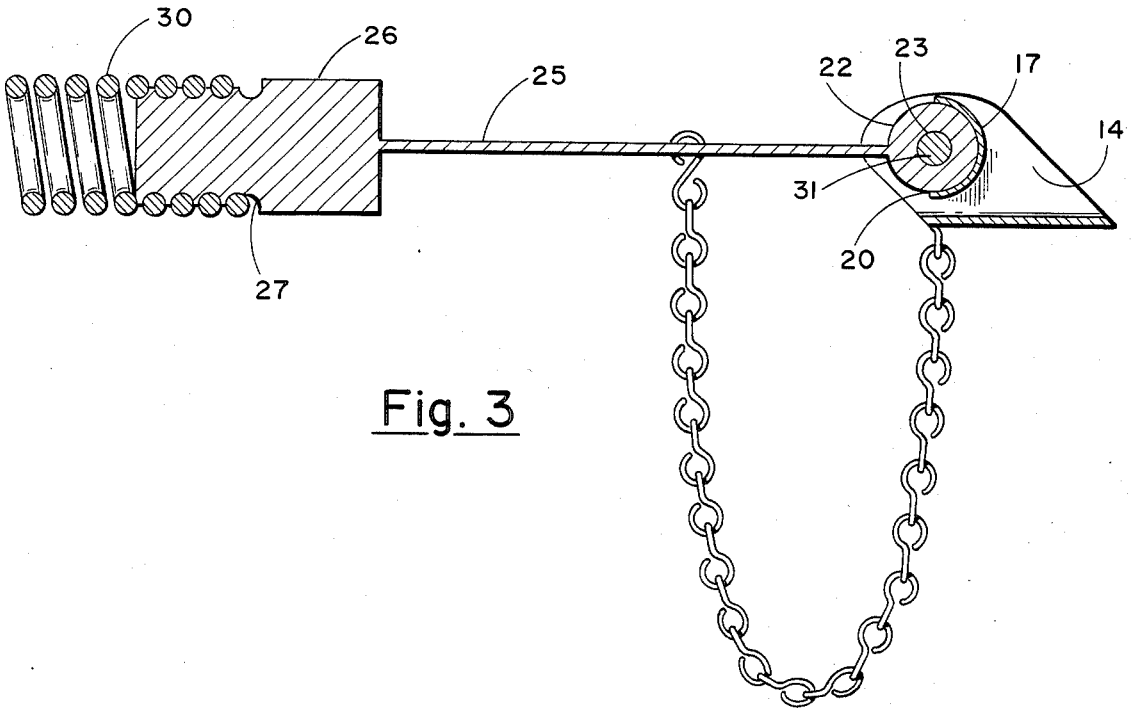
FIG. 3 is a partial vertical sectioned view showing the details of the construction of the invention.

In the description like parts will be identified with identical reference numerals.

A pair of identical brackets 10, one for mounting on a boat dock 11 and the other for mounting on the side or back of a boat 12, each have a base member 13 and a pair of upstanding, vertical, spaced-apart side members 14. Preferably, the brackets 10 are respectively attached to the boat and the dock in some convenient fashion such as by hexheaded bolts 15 passing through the base member 13. The side members 14 have apertures or holes 16 which are axially aligned with one another. Attached between the inside surfaces of the side members 14 is an arcuate or semi-cylindrical sleeve 17 to provide a generally semicircular bearing surface 20.

A pair of identical arms are generally designated by reference numeral 21. One arm is for coupling to the boat bracket and the other is for coupling to the dock bracket. Each arm 21 has at one end a transverse cylindrical or trunnion member 22 having an outer curvature corresponding to the curvature of the bearing surface 20 of sleeve member 17. An opening or passageway 23 extends completely through along the axis of trunnion 22. Extending radially outward from the outer surface of trunnion 22 is a rigid flat member 25 which terminates at its other end with a cylindrical member 26. The distal end of the cylindrical member 26 contains a series of outer grooves or threads 27 and an elongated helically wound spring 30 connects together the free ends of arms 21 by threadably engaging, at each end of the spring, the grooved or threaded end of each arm 21.

In use and when assembled together, trunnions 22 rest in respective bearing surfaces 20 of the boat bracket and the dock bracket with openings 23 aligned with openings 16 in the side members of the respective brackets and a rod or pin 31 is inserted through the aligned openings to hold the arms in place at the respective brackets. Pin 31 on the boat bracket has a ring member 33 attached at one end as a convenience to easily hold and slip the pin out of the openings to disconnect the arm from the boat bracket. Generally the arm coupled to the dock bracket is a more permanent attachment so the pin or rod may be in the form of an elongated bolt which passes through the openings and has a nut threaded on at one end to hold the arm onto the bracket. Preferably, as illustrated in FIG. 1, the dock bracket 10 is mounted near an edge of the dock so that when the arm is detached from the boat bracket, the two arms with the connecting spring 30 will swing down and rest alongside the dock and therefore be out of the way when not in use.

When the device is attached to the boat and to the dock as illustrated in FIG. 1, it can be observed that the various motions imparted to the boat as a result of movement of the water will be taken up by the pivotal attachment of the arms to the respective brackets, by the spring 30 compacting or extending, by flexing of spring 30 and/or by threading and/or unthreading action between the arms 21 and the spring 30. For example, if it is assumed that in FIG. 1 the boat bracket is attached to the side of the boat, as the boat pitches back and forth there likely will be some slipping of spring 30 in grooves or threads 27 thereby eliminating or minimizing the likelihood of any strong forces being applied to the brackets to tear them loose. If the boat should raise and drop with the movement of the water, the pivotal action between the arm trunnions 22 and the sleeves 17 on the brackets will accommodate that movement without applying any adverse force to the bracket or to the arms. Movement of the boat toward and away from the dock is taken up by spring 30 contracting or expanding. Yawing or turning of the boat caused by water movement will be taken up by bending of spring member 30.

The mooring fixture can be attached from the dock to the side, front or rear of the boat. Multiple mooring fixtures can be used if necessary.

Figure 4:
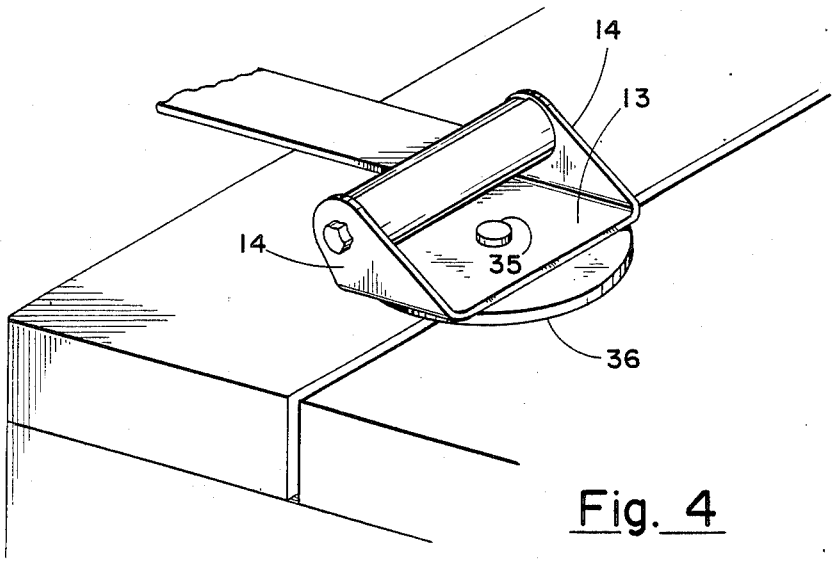
FIG. 4 illustrates an alternate manner of attaching the bracket to the dock.

As an alternative, as illustrated in FIG. 4, the boat bracket 10 may be rotatably mounted by pin 35 through base 13 onto a plate 36 instead of being mounted directly onto the boat dock. Plate 36 is attached in some convenient manner to the dock. In the arrangement shown in FIG. 4 the mooring device, after being disconnected from the boat, can be swung around to bring the arms and connecting spring to rest on top of the dock when not in use.

I claim:

1. A device for mooring a boat to a dock, comprising:

a dock bracket and a boat bracket each comprising a flat base and spaced-apart upstanding side members attached to said base;

means for attaching said dock bracket base to a dock;

means for attaching said boat bracket to a boat;

a pair of elongated rigid arms;

means for pivotably attaching one of said arms at one end between the side members of said dock bracket;

means for pivotably attaching the other of said arms at one end between the side members of said boat bracket;

each of said arms having a cylindrical outer-threaded member fixedly attached to the other end;

an elongated helically wound spring member threadably engaged with a respective one of said cylindrical members at each end of said spring;

each of said pivotably attaching means comprising a semi-cylindrical sleeve member having a semicircular bearing surface attached between the bracket side members;

a trunnion on each of said arms resting on said sleeve bearing surface, each trunnion having an axial through passage;

each of said bracket side members having an opening axially aligned with said trunnion passage; and a rod member extending through the openings in said bracket side members and through said trunnion passage.

2. The invention as described in claim 1 wherein the rod member in said boat bracket is removable for disengaging the arm from said boat bracket.

3. The invention as described in claim 2, further including:

a plate member attached to a dock; and means for rotatably attaching the base of said dock bracket to said plate member.

* * * * *